US011752384B2

(12) United States Patent
Yanez

(10) Patent No.: US 11,752,384 B2
(45) Date of Patent: Sep. 12, 2023

(54) TENSILE STRENGTH TRAINING DEVICE

(71) Applicant: FAST TWITCH MUSCLE TRAINER INC, Miami, FL (US)

(72) Inventor: Larry Yanez, Miami, FL (US)

(73) Assignee: FAST TWITCH MUSCLE TRAINER INC., Miami, FL (US)

( * ) Notice: Subject to any disclaimer, the term of this patent is extended or adjusted under 35 U.S.C. 154(b) by 251 days.

(21) Appl. No.: 17/233,034

(22) Filed: Apr. 16, 2021

(65) Prior Publication Data

US 2022/0331637 A1 Oct. 20, 2022

(51) Int. Cl.

| | |
|---|---|
| ***A63B 21/002*** | (2006.01) |
| ***A63B 21/00*** | (2006.01) |
| ***A63B 71/06*** | (2006.01) |
| ***A63B 21/16*** | (2006.01) |
| ***A63B 24/00*** | (2006.01) |

(52) U.S. Cl.

CPC ..... *A63B 21/0023* (2013.01); *A63B 21/169* (2015.10); *A63B 21/4035* (2015.10); *A63B 24/0062* (2013.01); *A63B 71/0622* (2013.01); *A63B 2071/0658* (2013.01); *A63B 2220/51* (2013.01); *A63B 2220/833* (2013.01)

(58) Field of Classification Search

CPC ..... A63B 21/072; A63B 21/06; A63B 21/062; A63B 21/0023; A63B 21/4035; A63B 24/0062; A63B 2071/0658; A63B 2220/51; A63B 2220/833; A63B 21/0004; A63B 21/0601; A63B 21/15; A63B 21/28; A63B 21/40; A63B 21/4027; A63B 22/002; A63B 23/12; A63B 43/12; A63B 2220/13; A63B 2220/16; A63B 2220/56; A63B 21/169

See application file for complete search history.

(56) References Cited

U.S. PATENT DOCUMENTS

| | | | |
|---|---|---|---|
| 2,313,862 | A | 3/1943 | Carliss |
| 3,097,524 | A | 7/1963 | Glerum |
| 5,471,885 | A | 12/1995 | Wagner |
| 7,559,252 | B2 | 7/2009 | Schadler et al. |

(Continued)

FOREIGN PATENT DOCUMENTS

CA 1090312 A * 11/1980 ..... A47F 7/175

*Primary Examiner* — Gary D Urbiel Goldner
*Assistant Examiner* — Sara K. Conway
(74) *Attorney, Agent, or Firm* — Mark C. Johnson; Johnson Dalal

(57) ABSTRACT

A tensile strength training device having a handheld housing with a curved electronic display panel defining a housing channel and with a left side panel and a right side panel each flanking and coupled to the curved electronic display panel, each with a sidewall defining a concave cavity, two opposing handle apertures, and two opposing bracket apertures. Left and right U-shaped handle brackets are disposed within the respective two opposing bracket apertures and coupled to a handle member disposed within the concave cavity thereon for grasping by a user and disposed within the two opposing handle apertures. The device includes a printed circuit board electrically coupled to a power source, a force sensor operably coupled to the left and right U-shaped handle brackets, and operably configured to measure a tensile force applied thereto that is able to be displayed around at least 180° of the curved electronic display panel.

19 Claims, 9 Drawing Sheets

(56) References Cited

U.S. PATENT DOCUMENTS

| | | | | |
|---|---|---|---|---|
| 8,783,115 | B2 | 7/2014 | Chen | |
| 11,571,608 | B2 * | 2/2023 | Sands | A63B 21/4035 |
| 2010/0041490 | A1 * | 2/2010 | Boyd | A63B 53/0466<br>473/290 |
| 2011/0065550 | A1 * | 3/2011 | Cohn | A63B 21/0004<br>482/8 |
| 2014/0367351 | A1 * | 12/2014 | Juen | A63B 71/0036<br>211/85.7 |
| 2015/0345925 | A1 * | 12/2015 | Smit | G01L 5/00<br>702/150 |
| 2016/0030829 | A1 * | 2/2016 | Rowsey | A63B 69/38<br>340/323 R |
| 2018/0078183 | A1 * | 3/2018 | Lor | G06F 3/011 |
| 2020/0222746 | A1 * | 7/2020 | Obray | A63B 23/03508 |

* cited by examiner

TENSILE STRENGTH TRAINING DEVICE

FIELD OF THE INVENTION

The present invention relates generally to portable training devices and, more particularly, relates to devices operably configured to enable a user to selectively apply and view the amount of force or pressure to the device.

BACKGROUND OF THE INVENTION

Many users utilize one or more training device(s) to target or strengthen one or more different muscle groups and/or for cardiovascular purposes. Many users also desire to know the amount of force applied with said training devices(s) for improvement and/or recording purposes. Those known training device(s) fail to provide users with the ability to know the amount force or pressure applied in training, much less enabling a user to do so in a safe, effective, and efficient manner.

Furthermore, those known devices enabling the user to train by applying tensile forces and pressures do not permit the user to target different muscle groups in a variety of ways. For example, there may be devices with one or more grips that allow a user to apply tensile forces for a user's arms, but they do not permit rotation or angular positioning of the user's arms when the tensile force is applied. Moreover, those known devices also do not permit the user to receive notification of the force(s) by the user in a safe, effective, and efficient manner.

Therefore, a need exists to overcome the problems with the prior art as discussed above.

SUMMARY OF THE INVENTION

The invention provides a tensile strength training device that overcomes the hereinafore-mentioned disadvantages of the heretofore-known devices and methods of this general type and that enables users to apply and measure tensile forces with or without an external structure in a training environment. Said another way, the training product of the present invention differs from any other product on the market because of its ability to target different muscles by overcoming isometrics. Specifically, the present invention measures pounds of pressure or force and, because of its unique design, can be used in multiple angles and variations like no other device on the market. Because of its design, the present invention also enables users to push against a wall or other external structure and target different muscles.

With the foregoing and other objects in view, there is provided, in accordance with the invention, a tensile strength training device that includes a handheld housing with a curved electronic display panel defining a housing channel and with a left side panel and a right side panel each flanking and coupled to the curved electronic display panel, each with a sidewall defining a concave cavity, two opposing handle apertures, and two opposing bracket apertures. The device also includes a left U-shaped handle bracket disposed within the two opposing bracket apertures of the left side panel and coupled to a left handle member disposed within the concave cavity thereon for grasping by a user and disposed within the two opposing handle apertures of the left side panel and a right U-shaped handle bracket disposed within the two opposing bracket apertures of the right side panel and coupled to a right handle member 300 disposed within the concave cavity thereon for grasping by the user and disposed within the two opposing handle apertures of the right side panel. The device also includes a printed circuit board disposed within the housing channel and electrically coupled to a power source, to at least one force sensor operably coupled to the left and right U-shaped handle brackets and operably configured to measure a tensile force applied to at least one of the left and right handle members, and to the curved electronic display panel, wherein the curved electronic display panel is operably configured to display an image of a measured tensile force applied to the at least one of the left and right handle members around at least 180° of the curved electronic display panel.

In accordance with a further feature of the present invention, the curved electronic display panel is cylindrical.

In accordance with another feature, an embodiment of the present invention includes the handheld housing having two trim pieces each respectively coupled to one of the side panels and covering the ends of either the left U-shaped handle bracket or the ends of right U-shaped handle bracket.

In accordance with yet another feature, an embodiment of the present invention also includes the two trim pieces having a circular channel with a deformably resilient pad disposed therein and defining opposing terminal ends of the handheld housing.

In accordance with an additional feature of the present invention, the left U-shaped handle bracket is coupled to opposing ends of the left handle member with a handle fastener and the right U-shaped handle bracket is coupled to opposing ends of the right handle member with a handle fastener.

In accordance with an exemplary feature of the present invention, the left and right U-shaped handle brackets each include a base flanked by two cantilevered arms, the base of the left and right U-shaped handle brackets mechanically coupled together with the at least one bracket fastener.

In accordance with yet another feature, an embodiment of the present invention also includes a center weight flanked by, and mechanically coupled with the at least one bracket fastener, the base of both the left and right U-shaped handle brackets.

In accordance with a further feature, an embodiment of the present invention also include a gyroscope electrically coupled to the printed circuit board and operably configured to align the image of the measured tensile force applied displayed on the curved electronic display panel with a handle plane defined by an orientation of the left and right handle members.

In accordance with yet another feature, an embodiment of the present invention also includes a plurality of buttons electrically coupled to the printed circuit board and the curved electronic display panel, the plurality of buttons operably configured to selectively, rotationally, and incrementally move the image of the measured tensile force applied displayed on the curved electronic display panel.

In accordance with another feature, an embodiment of the present invention also includes a translucent lens plate housing at least one LED and coupled to the sidewall of the left side panel and a translucent lens plate housing at least one LED and coupled to the sidewall of the right side panel, the at least one LED at both the sidewalls of left side panel and the right side panel operably configured to emit a light therefrom when the measured tensile force applied to the at least one of the left and right handle members reaches a desired tensile force stored in a memory electrically coupled to the printed circuit board.

In accordance with a further feature, an embodiment of the present invention also includes a wall pad clip having a front surface opposing a rear surface, the front surface having a clip member disposed thereon and selectively removably coupled to one of the handle members.

In accordance with a further feature of the present invention, the clip member includes two arcuate clip arms operably configured to flex and compress the one of the handle members disposed within a cylindrical clip channel defined thereon.

In accordance with another feature, an embodiment of the present invention also includes the wall pad clip having a deformably resilient pad coupled to the rear surface of the wall pad clip and defining a planar surface defining one of the opposing terminal ends of the device in a longitudinal direction.

Also in accordance with the present invention, a tensile strength training device is disclosed that includes a handheld housing with a curved electronic display panel defining a housing channel and with a left side panel and a right side panel each flanking and coupled to the curved electronic display panel and each with a sidewall defining a concave cavity. Further, the device includes a left handle bracket coupled to the left side panel and a left handle member disposed within the concave cavity thereon for grasping by a user and a right handle bracket coupled to the right side panel and a right handle member disposed within the concave cavity thereon for grasping by the user. The device also includes a printed circuit board disposed within the housing channel and electrically coupled to a power source, to at least one force sensor operably coupled to the left and right handle brackets and operably configured to measure a tensile force applied to at least one of the left and right handle members, and to the curved electronic display panel, the curved electronic display panel operably configured to display an image of a measured tensile force applied to the at least one of the left and right handle members around at least 180° of the curved electronic display panel. The device also includes a wall pad clip having a front surface opposing a rear surface, the front surface having a clip member disposed thereon and selectively removably coupled to one of the handle members, wherein the rear surface is planar.

Although the invention is illustrated and described herein as embodied in a tensile strength training device, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description. As used herein, the term "wall" is intended broadly to encompass continuous structures, as well as, separate structures that are coupled together so as to form a substantially continuous external surface.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to a direction spanning from side-to-side of the device, wherein traverse or lateral should be understood to mean in a direction corresponding opposite or 90° with respect to the longitudinal direction. The terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 2:
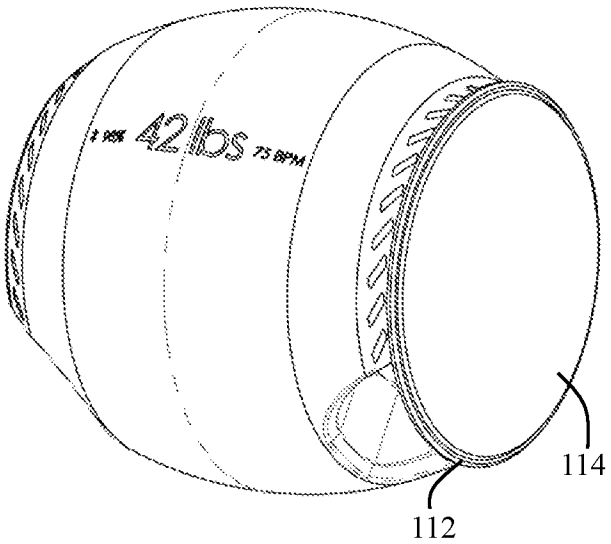
FIG. 2 is a perspective view of the tensile strength training device in FIG. 1.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient device for measuring and displaying a tensile force applied by the user. Embodiments of the invention provide the user to utilize the device with two hands, in various angular positions, in addition to utilization with a single hand against an external structure, such as a wall.

Figure 1:
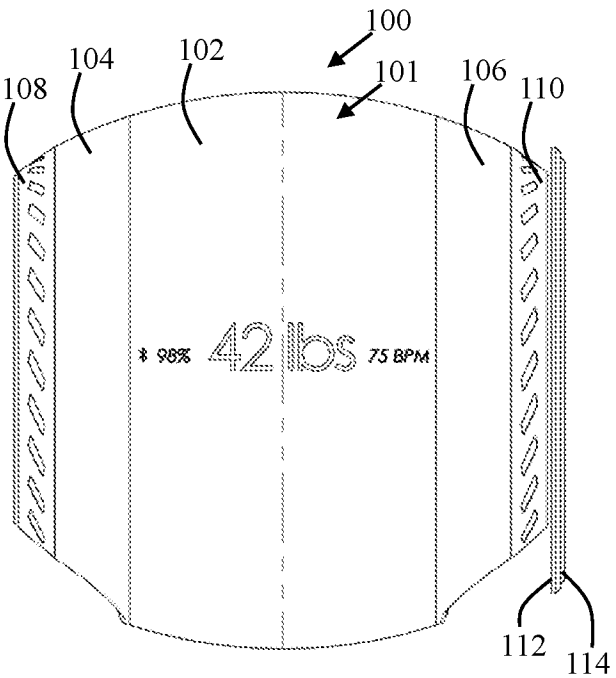
FIG. 1 is an elevational front view of the tensile strength training device in accordance with one embodiment of the present invention.

Referring now to FIG. 1, one embodiment of the present invention is shown in an elevational side view. FIG. 1 shows several advantageous features of the present invention, but, as will be described below, the invention can be provided in several shapes, sizes, combinations of features and components, and varying numbers and functions of the components. The first example of a tensile strength training device, as shown best in FIG. 1, FIG. 5, and FIG. 7, includes a handheld housing 101 with a curved electronic display panel 102, a left side panel 104, a right side panel 106, two trim pieces 108, 110, and a wall pad clip 112 which are all coupled together and may all (at least partially with respect to the electronic display panel 102) be of a substantially rigid, lightweight, and durable material such as polycarbonate.

Specifically, the curved electronic display panel 102 may define a housing channel 516 that may be cylindrical or curved as well, wherein said housing channel 516 may provide an area where the electronic and other components of the device 100 are stored and retained. In one embodiment, the electronic display 102 is cylindrical, while in other embodiments it may be spherical and/or only partially curved. In further embodiments, the display may have flat sections that still generate an appearance of a curved electronic display. In one embodiment, the curved electronic display panel 102 may include a back panel 500 that may selectively removably couple thereto using one or more fasteners (as depicted best in FIG. 5).

The left side panel 104 and a right side panel 106 may each be of a ring-like or annular shape and may each flank and couple to the curved electronic display panel 102 using, for example, a clip fastener. The left and right side panels 104, 106 may include a sidewall, e.g., sidewall 308, defining a concave cavity 310, two opposing handle apertures 700, 702, and two opposing bracket apertures 704, 706. The sidewall 308 may completely enclose the concave cavity and include a bottom wall to prevent injury to the user when inserting his or her hand into the cavity 310 and/or if the user's hand slips off of the handle members. As seen best in FIG. 1, FIG. 3, and FIG. 5, the housing 101 can also be seen having two opposing terminal ends that may each include an annular surface that is planar (as defined herein) and that surrounds the concave cavity 310.

Figure 5:
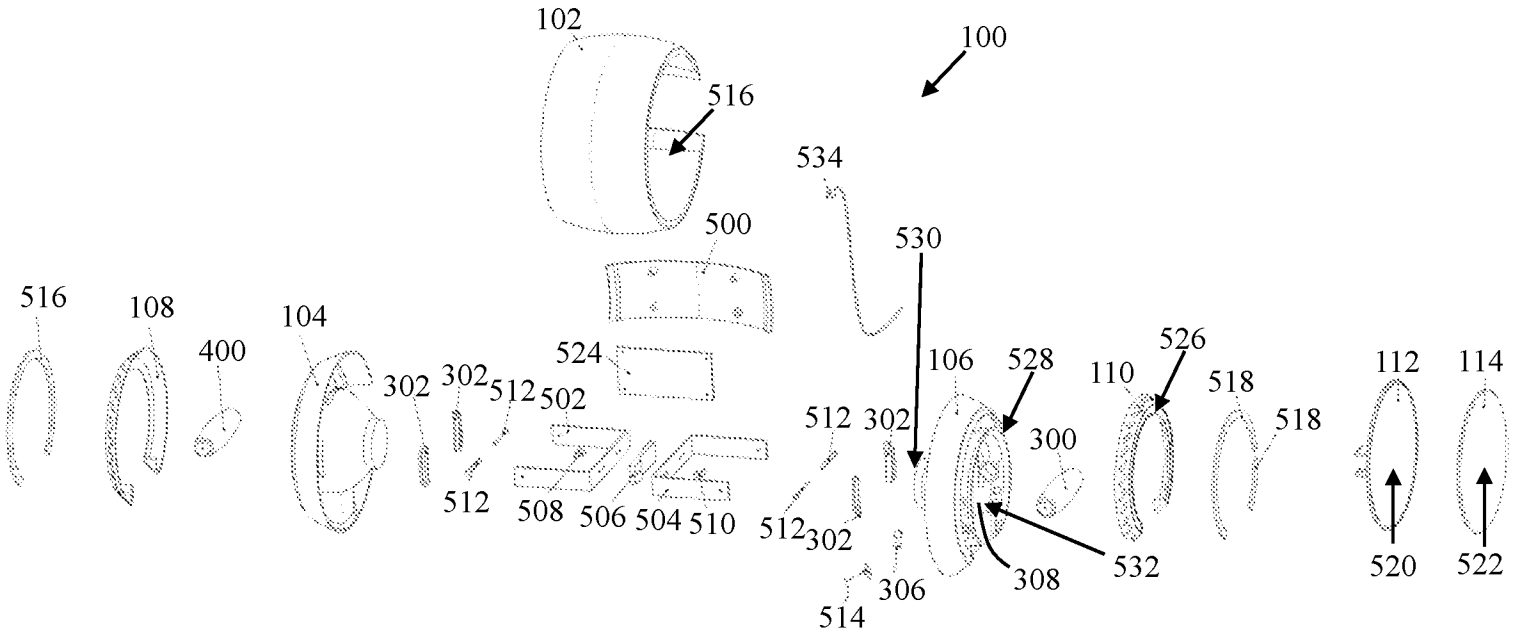
FIG. 5 is an exploded view of the tensile strength training device in FIG. 1.
Figure 6:
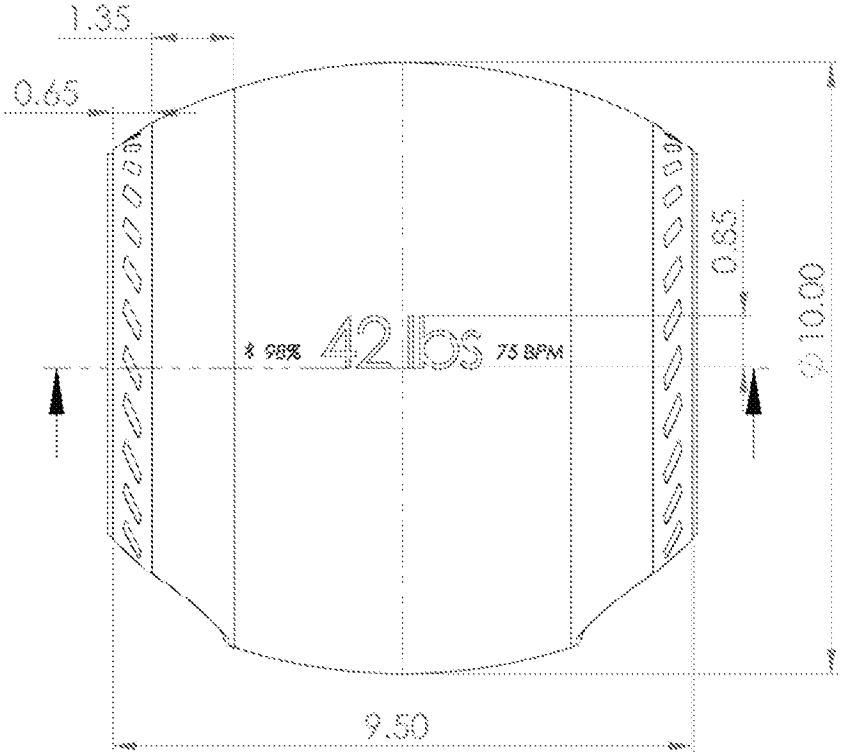
FIG. 6 is an elevational front view of the tensile strength training device in FIG. 1 with the wall pad clip removed therefrom.
Figure 7:
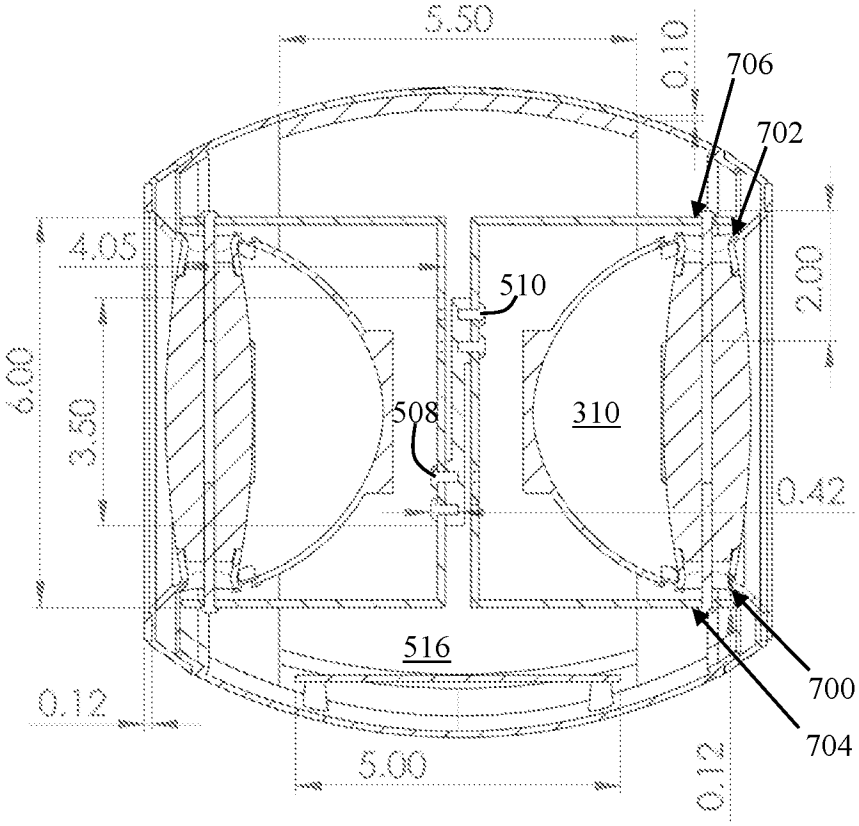
FIG. 7 is a cross-sectional view of the tensile strength training device in FIG. 1 about a central axis with the wall pad clip removed therefrom.
Figure 9:
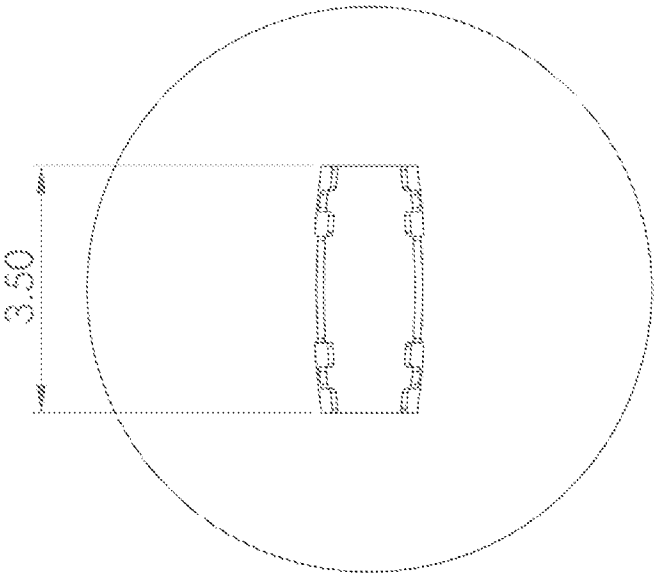
FIG. 9 is an elevational side view of the wall pad clip in accordance with one embodiment of the present invention.
Figure 8:
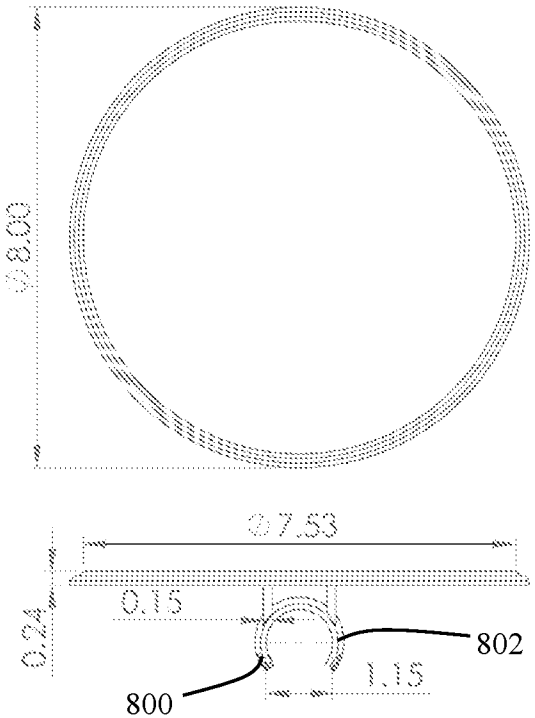
FIG. 8 is an elevational front view and top plan view of the wall pad clip in accordance with one embodiment of the present invention.
Figure 10:
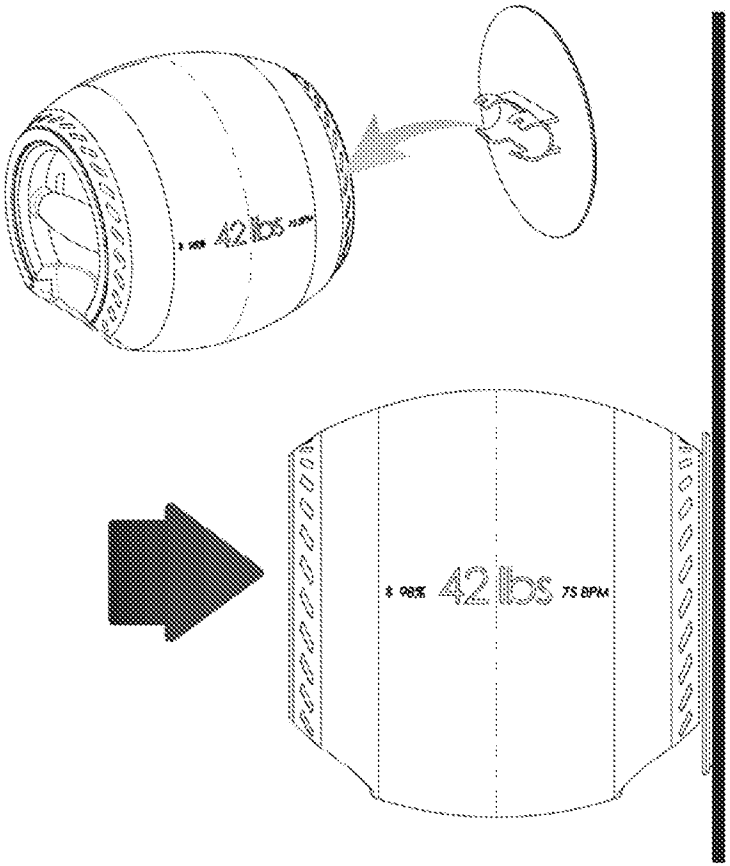
FIG. 10 is a perspective view and front elevational view of the tensile strength training device in FIG. 1 with the wall pad clip removed therefrom and attached to an exemplary external structure, e.g., wall, and applied force in accordance with one embodiment of the present invention.

As seen in FIG. 5 and FIG. 7, the device 100 may also include left and right brackets 502, 504 that may preferably U-shaped and may be disposed outside of the concave cavity 310. The left U-shaped handle bracket 502 may be disposed within the two opposing bracket apertures 704, 706 of the left side panel 104 and coupled to the left handle member 400 disposed within the concave cavity 310 thereon for grasping by a user. The handle member 400 may be disposed within the two opposing handle apertures 700, 702 of the left side panel 104 and directly coupled to the sidewall of the left side panel 104 with a clip fastener, compression, or other means. Similarly, the right U-shaped handle bracket 504 may be disposed within the two opposing bracket apertures of the right side panel 106 and coupled to a right handle member 300 disposed within the concave cavity thereon for grasping by the user. The right U-shaped handle bracket 504 may be disposed within the two opposing handle apertures 700, 702 of the right side panel 106 and directly coupled to the sidewall of the left side panel 104 with a clip fastener, compression, or other means.

Figure 3:
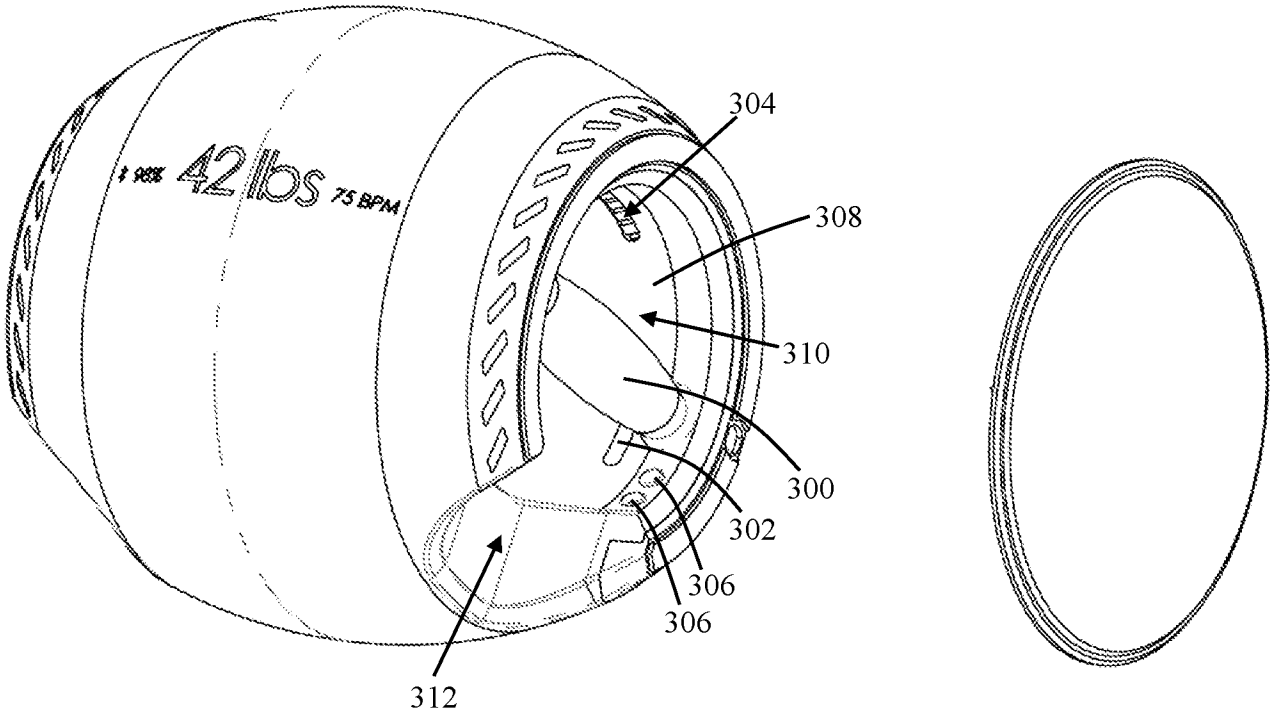
FIG. 3 is a partially exploded view of the tensile strength training device in FIG. 1 with the wall pad clip removed therefrom.
Figure 4:
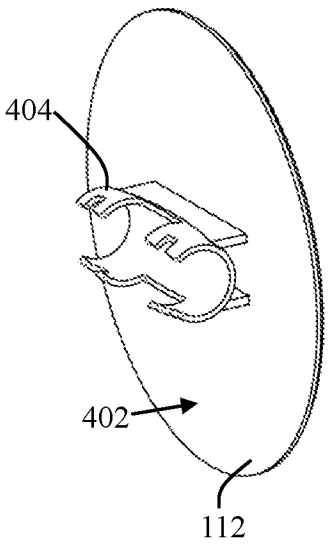
FIG. 4 is another partially exploded view of the tensile strength training device in FIG. 1 with the wall pad clip removed therefrom.
Figure 4:
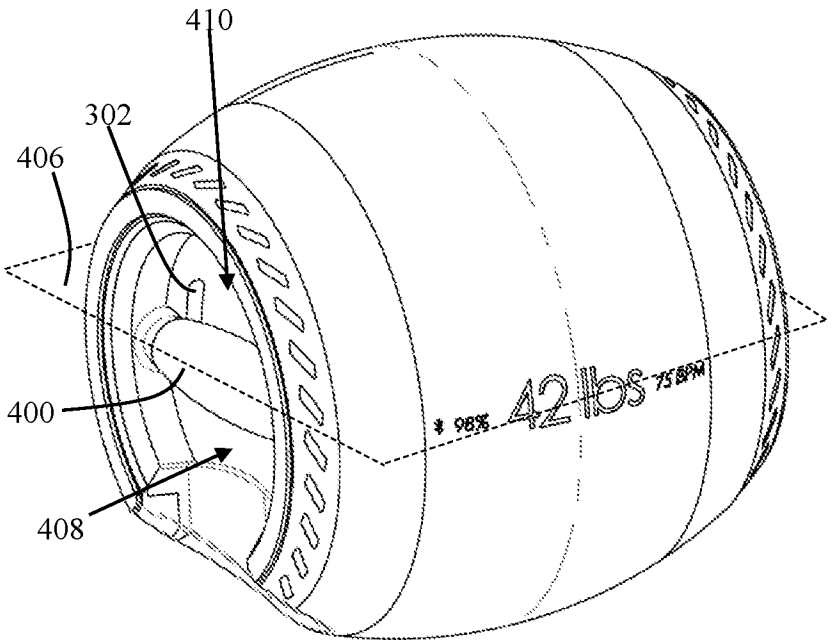

With reference to FIGS. 3-5, the left and right side panels 104, 106 may also include a distal front edge, e.g., distal front edge 528, opposing a rear end 530 (or bottom wall) of the sidewall 308. The distal front edge 528 may define and enclose a side panel opening 532 spatially coupled to the concave cavity 310 on each of the side panels 104, 106. The handle members 400, 300 are coupled to the sidewalls in a configuration that bifurcates the concave cavity 310 into two spaces, e.g., spaces 408, 410, on opposite sides of the handle member, thereby providing user effective and safe access to the cavity 310 through the side panel opening. Furthermore, the distal front edge 528 may also define a recessed access cavity 312 around a perimeter thereon for permitting a user access to remove the wall pad clip 112 when coupled to one of the handle members 400, 300 as discussed herein. To effectuate the access, the two trim pieces 108, 110 may also define a space aligned with the recessed access cavity 312 (also depicted in FIG. 3).

Beneficially, the device 100 includes a printed circuit board (PCB) 524 disposed within (either directly or indirectly) the housing channel 516. The PCB 524 may mechanically support and electrically connect various electrical or electronic components within the device 100 using conductive tracks, pads and other features etched from one or more sheet layers of copper laminated onto and/or between sheet layers of a non-conductive substrate. Components are generally soldered onto the PCB to both electrically connect and mechanically fasten them to it. For the purposes of this application the PCB 524 should also be construed (unless otherwise stated) to include an electronic controller or electronic control unit. Some exemplary electrical components can be seen depicted in the schematic diagram depicted in FIG. 11.

Figure 11:
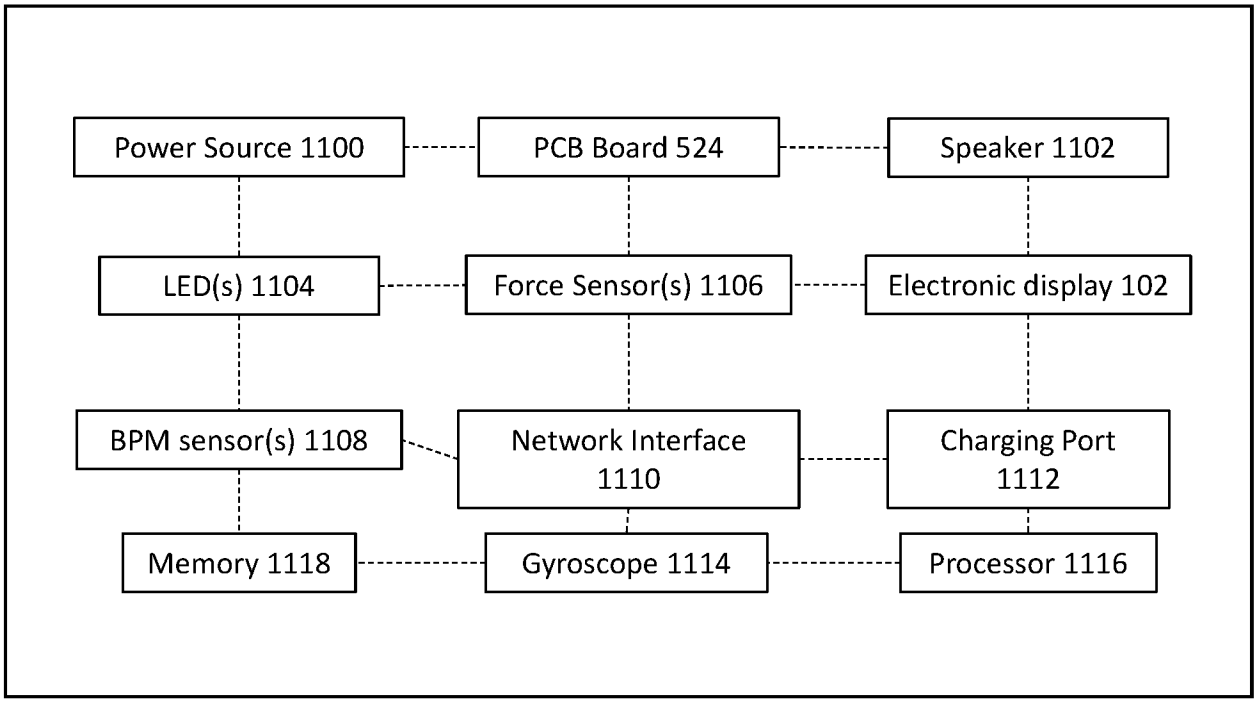
FIG. 11 is a schematic diagram depicting exemplary electrical components utilized with tensile strength training device in accordance with one embodiment of the present invention.

With reference to FIGS. 4-5 and FIG. 11, the PCB 524 is electrically coupled to a power source 1100 (e.g., lithium-ion battery, that may be rechargeable), at least one force sensor 1106 operably coupled to the left and right U-shaped handle brackets 502, 504 and operably configured to measure a tensile force applied to at least one of the left and right handle members 400, 300. The force sensor 1106 is known in the art to operably couple with one or more structure(s) to measure and relay a tensile force or strain applied to said structure(s). Exemplary force sensors are discussed, for example, in Carliss, U.S. Pat. No. 2,313,862, Glerum, U.S. Pat. No. 3,097,524, Wagner, U.S. Pat. No. 5,471,885, Schadler et al., U.S. Pat. No. 7,559,252, and Chen, U.S. Pat. No. 8,783,115 (the entirety is incorporated herein by reference). The standard for measuring tensile forces may also be carried out using one or more of the ASTM standards (as is known in the art).

The PCB is electrically coupled to the curved electronic display panel 102, wherein the curved electronic display panel 102 is beneficially operably configured to display an image of a measured tensile force applied to the at least one of the left and right handle members 400, 300 around at least 180° of the curved electronic display panel 102. The ability for the electronic display panel 102 to display the measured tensile force by the force sensor(s) 1106 around at least 180° of the display enables the user to visually see the measured tensile force(s) in various angles and orientations of the device 100.

The device 100 may also utilize a center weight 506 flanked by, and mechanically coupled with one or more of the bracket fastener(s) 508, 510, the base of both the left and right U-shaped handle brackets 502, 504. The center weight 506 facilitates in effectuating an accurate reading of tensile force applied through the handle members 400, 300 and brackets 502, 504. The center weight 506 may be centrally disposed in the device, i.e., at or near the center of mass of the device (without the clip member 112 attached) and beneficially includes two offset portions.

To effectively display the measured tensile force, the device 100 may include a gyroscope 1114 electrically coupled to the PCB 524, wherein the gyroscope 1114 is operably configured to align the image of the measured tensile force applied displayed on the curved electronic display panel 102 with a handle plane 406 defined by an orientation of the left and right handle members 400, 300. In addition to or in lieu of the gyroscope 1114, the device 100 may include a plurality of buttons 306 electrically coupled to the PCB 524 and the curved electronic display panel 102. The plurality of buttons 306 are operably configured to selectively, rotationally, and incrementally move (e.g., in 0.25 inch radial increments) the image of the measured tensile force applied displayed on the curved electronic display panel 102, thereby providing enhanced versatility for viewing the measured tensile force.

The device may also include one or more translucent lens plate(s) 302 housing at least one LED, e.g., LED 1104, and that is coupled to the sidewall 308 of the left and/or right side panels 104, 106. "Translucent" is also defined to include transparent materials unless otherwise explicitly stated. The LED(s) at one or both of the sidewalls of left and/or right side panel(s) 104, 106 are operably configured to emit a light therefrom when a measured tensile force applied to one or both of the left and right handle members 400, 300 reaches a desired tensile force stored in a memory 1118 electrically coupled to the printed circuit board 524. Said another way, the LEDs light up when the user reaches a desired tensile force. This desired tensile force can of course be selectively modified by the user and/or programmed into the memory 1118 for recall by a processor 1116. The memory 1118 may also include one or more stored programs designed to challenge the user. Additionally, the device 100 may also include a networking interface 1110 for communicatively coupling with another external electronic device, e.g., cellphone, wherein the cellphone may include a resident software application and interface operably configured to permit user control and programming of the electronic components housed by the device 100.

Still referring to FIG. 11, the device 100 may also include a speaker 1102 or microphone disposed proximal to an aperture 304 (see FIG. 3) that is also operable to emit sounds that include the measured tensile force, battery level, beats per minute (BPM) measured by a BPM sensor 1108 embedded in or otherwise operably coupled to the handle members 400, 300. The device 100 may also include an inductive charging port 1112 operably configured to engage or couple with an inductive or charging cable 534 operably configured to electrically couple with an external power source (for charging the battery 1100 or otherwise providing power to the electrical components on the device 100).

With reference to FIG. 5, an exploded view of the tensile strength training device 100 is depicted. Specifically, the device 100 may include the curved or electronic display panel 102, a back panel 500, the two opposing side panels 104, 106 that may all snap fit or otherwise couple with one another and may be of a substantially rigid, yet slightly flexible material, e.g., polycarbonate or PVC. The device 100 can also be seen having handle brackets 502, 504 that may be of a U-shape and configured to insert through one of the respective side panels 104, 106. The handle brackets 502, 504 may flank a center weight 506. The handle brackets 502, 504 and center weight 506 may be coupled together using, for example, one or more bracket fasteners 508, 510. More specifically, the fasteners 508, 510 may mechanically couple the brackets 502, 504 and weight 506 together. To that end, the weight 506 may also include one or more threaded apertures on opposing sides to matingly receive the bracket fasteners 508, 510 having a corresponding thread configuration.

Referring to FIGS. 3-5, the device 100 can also be seen having two opposing handle members 300, 400 each respectively coupled to one or more handle fasteners 512. Specifically, the handle fasteners 512 may be a threaded screw operably configured to be matingly received within threaded apertures on opposing sides of the handle members 300, 400 that have a corresponding thread configuration. The handle fasteners 512 may also be inserted through apertures defined on opposing ends of the brackets 502, 504 to secure them to the device 100 in a traverse orientation.

The side panels 104, 106 may each also define an aperture, e.g., aperture 304, that may be elongated and may include a speaker 1102 disposed thereon (as shown in the figures). Additionally, the side panels 104, 106 may each define a light aperture for a clear or translucent lens plate 302 and apertures for one or more buttons 306, 514. The translucent lens plate 302 (and LED or other light disposed therein) advantageously permits the device to emit a light perceivable to the user while utilizing the device 100 when, for example, a determined force is reached. The buttons 306, 514 enable selective control of the device's functionality, e.g., volume of sound emitted from the speaker, or placement of digital information on the electronic display 102.

Still referring to FIGS. 3-5, the device 100 includes side trim pieces 108, 110 operably configured to selectively couple and uncouple with the side panels 104, 106 and cover the ends of the brackets 502, 504 that couple with the handle members 300, 400. Additionally, the device 100 beneficially includes deformably resilient ring-like or annular member or pads 516, 518. The pads 516, 518 may also be of a polymeric material, e.g., dense or closed-cell EVA foam. The pads 516, 518 may each be formed with two layers or otherwise configured to matingly couple with an end or recessed cavity of the side panels 104, 106. In preferred embodiments, a thickness of the pads 516, 518 project a distance, e.g., approximately 0.12 inches, from the terminal end of the side panels 104, 106 to provide a dampening effect when placed against an external structure or and/or protect the surface of the external structure. The pads 516, 518 may be retained and coupled to the side panels 104, 106 with friction and/or compression forces, adhesive, and/or one or more fasteners.

The device 100 may also beneficially include a wall pad clip 112 and pad 114 coupled thereto. The wall pad clip 112 may be of substantially rigid material, e.g., a polymeric material such as high-density polyethylene. The pad 114 may be of a deformably resilient material, similar to the pads 516, 518. The wall pad clip 112 includes a front surface 402 and an opposing rear surface 520, wherein the front surface 402 includes a clip member 404 operably configured to selectively couple and uncouple with one or both of the handle members 300, 400. It should be understood that terms such as, "front," "rear," "side," top," "bottom," and the like are indicated from the reference point of a viewer viewing the device 100 and may vary based on the user's perspective. The clip member 404 may also include two arcuate clip arms 800, 802 operably configured to flex and compress the one of the handle members 400, 300 disposed within a cylrindical clip channel 804 defined thereon. This enables quick and effective attachment and release of the wall pad clip 112. The wall pad clip 112 may also include a deformably resilient pad 114 coupled to the rear surface 520 of the wall pad clip 112 and defining a planar (i.e., substantially planar) surface defining one of the opposing terminal ends of the device 100 in a longitudinal direction.

With reference to FIG. 1 and FIG. 5, the handheld housing 101 may also include the two trim pieces 108, 110 each respectively coupled to one of the side panels 104, 106 using fasteners or adhesive and that cover the ends of either the left U-shaped handle bracket 502 or the ends of right U-shaped handle bracket 504 (depending on what side they are connected). The two trim pieces 108, 110 may also each include a circular channel 526 with a deformably resilient pad 518 disposed therein and defining opposing terminal ends of the handheld housing 101. This would provide protection for the user, the device 100, and external structures when utilized by the user. Furthermore, the left U-shaped handle bracket 502 is coupled to opposing ends of the left handle member 400 with a handle fastener 512 and the right U-shaped handle bracket 504 is coupled to opposing ends of the right handle member 300 with a handle fastener 512. Additionally, the left and right U-shaped handle brackets 502, 504 may also each include a base flanked by two cantilevered arms, the base of the left and right U-shaped handle brackets 502, 504 mechanically coupled together with the at least one bracket fastener 508, 510.

Although a specific order of executing the process of use steps has been disclosed or otherwise taken from the figures, the order of executing the steps may be changed relative to the order shown in certain embodiments. Also, two or more steps shown in succession may be executed concurrently or with partial concurrence in some embodiments. Certain steps may also be omitted for the sake of brevity. In some embodiments, some or all of the process steps included can be combined into a single process.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A tensile strength training device comprising:

a handheld housing with:

a curved electronic display panel defining a housing channel;

a left side panel and a right side panel each flanking and coupled to the curved electronic display panel and each with a sidewall defining a concave cavity, two opposing handle apertures, and two opposing bracket apertures; and two opposing terminal ends having at least one of the two opposing terminal ends having an annular planar surface surrounding the concave cavity;

a left U-shaped handle bracket disposed within the two opposing bracket apertures of the left side panel and coupled to a left handle member disposed within the concave cavity thereon for grasping by a user and disposed within the two opposing handle apertures of the left side panel and a right U-shaped handle bracket disposed within the two opposing bracket apertures of the right side panel and coupled to a right handle member disposed within the concave cavity thereon for grasping by the user and disposed within the two opposing handle apertures of the right side panel; and a printed circuit board disposed within the housing channel and electrically coupled to a power source, to at least one force sensor operably coupled to the left and right U-shaped handle brackets and operably configured to measure a tensile force applied to at least one of the left and right handle members, and to the curved electronic display panel, the curved electronic display panel operably configured to display an image of a measured tensile force applied to the at least one of the left and right handle members around at least 180° of the curved electronic display panel.

2. The tensile strength training device according to claim 1, wherein:

the curved electronic display panel is cylindrical.

3. The tensile strength training device according to claim 1, wherein the handheld housing further comprises:

an end of the left U-shaped handle bracket, an end of the right U-shaped handle bracket, and two trim pieces each respectively coupled to one of the side panels and covering either the ends of the left U-shaped handle bracket or the ends of the right U-shaped handle bracket.

4. The tensile strength training device according to claim 3, wherein the two trim pieces each further comprise:

a circular channel with a deformably resilient pad disposed therein and defining the opposing terminal ends of the handheld housing.

5. The tensile strength training device according to claim 1, wherein:

the left U-shaped handle bracket is coupled to opposing ends of the left handle member with a handle fastener and the right U-shaped handle bracket is coupled to opposing ends of the right handle member with a handle fastener.

6. The tensile strength training device according to claim 1, wherein:

the left and right U-shaped handle brackets each include a base flanked by two cantilevered arms, the base of the left and right U-shaped handle brackets mechanically coupled together with at least one bracket fastener.

7. The tensile strength training device according to claim 6, further comprising:

a center weight flanked by, and mechanically coupled with the at least one bracket fastener, the base of both the left and right U-shaped handle brackets.

8. The tensile strength training device according to claim 1, further comprising:

a gyroscope electrically coupled to the printed circuit board and operably configured to align the image of the measured tensile force applied displayed on the curved electronic display panel with a handle plane defined by an orientation of the left and right handle members.

9. The tensile strength training device according to claim 1, further comprising:

a plurality of buttons electrically coupled to the printed circuit board and the curved electronic display panel, the plurality of buttons operably configured to selectively, rotationally, and incrementally move the image of the measured tensile force applied displayed on the curved electronic display panel.

10. The tensile strength training device according to claim 1, further comprising:

a translucent lens plate housing at least one LED and coupled to the sidewall of the left side panel and a translucent lens plate housing at least one LED and coupled to the sidewall of the right side panel, the at least one LED at both the sidewalls of the left side panel and the right side panel operably configured to emit a light therefrom when the measured tensile force applied to the at least one of the left and right handle members reaches a desired tensile force stored in a memory electrically coupled to the printed circuit board.

11. The tensile strength training device according to claim 1, further comprising:

a wall pad clip having a front surface opposing a rear surface, the front surface having a clip member disposed thereon and selectively removably coupled to one of the handle members.

12. The tensile strength training device according to claim 11, wherein:

the clip member includes two arcuate clip arms operably configured to flex and compress the one of the handle members disposed within a cylindrical clip channel defined thereon.

13. The tensile strength training device according to claim 11, wherein the wall pad clip further comprises:

a deformably resilient pad coupled to the rear surface of the wall pad clip and defining a planar surface, wherein the front surface of the wall pad clip is configured to couple to the one of the two opposing terminal ends in a longitudinal direction.

14. A tensile strength training device comprising:

a handheld housing with a curved and cylindrical electronic display panel defining a housing channel and with a left side panel and a right side panel each flanking and coupled to the curved electronic display panel and each with a sidewall defining a concave cavity;

a left handle bracket coupled to the left side panel and a left handle member disposed within the concave cavity thereon for grasping by a user and a right handle bracket coupled to the right side panel and a right handle member disposed within the concave cavity thereon for grasping by the user;

a printed circuit board disposed within the housing channel and electrically coupled to a power source, to at least one force sensor operably coupled to the left and right handle brackets and operably configured to measure a tensile force applied to at least one of the left and right handle members, and to the curved electronic display panel, the curved electronic display panel operably configured to display an image of a measured tensile force applied to the at least one of the left and right handle members around at least 180° of the curved electronic display panel; and a wall pad clip having a front surface opposing a rear surface, the front surface having a clip member disposed thereon and selectively removably coupled to one of the handle members, wherein the rear surface is planar.

15. The tensile strength training device according to claim 14, further comprising:

two opposing handle apertures and two opposing bracket apertures defined on each of the sidewalls of the left and right side panels, wherein the left handle bracket is U-shaped and disposed within the two opposing bracket apertures of the sidewall of the left side panel and with the left handle member disposed within the two opposing handle apertures defined by the sidewall of the left side panel and the right handle bracket is U-shaped and disposed within the two opposing bracket apertures of the sidewall of the right side panel and with the right handle member disposed within the two opposing handle apertures defined by the sidewall of the right side panel.

16. The tensile strength training device according to claim 14, wherein the left and right side panels further comprise:

a distal front edge opposing a rear end of the sidewall respectively thereon and defining a side panel opening spatially coupled to the concave cavity respectively thereon, wherein the handle member coupled thereto bifurcates the concave cavity into two spaces on opposite sides of the handle member, thereby providing access to the user thereto through the side panel opening.

17. The tensile strength training device according to claim 16, wherein:

the clip member includes two arcuate clip arms operably configured to flex and compress the one of the handle members disposed within a cylindrical clip channel defined thereon.

18. The tensile strength training device according to claim 16, wherein the wall pad clip further comprises:

a deformably resilient pad coupled to the rear surface of the wall pad clip and defining a planar surface defining one of two opposing terminal ends of the tensile strength training device in a longitudinal direction.

19. A tensile strength training device comprising:

a handheld housing with a curved electronic display panel defining a housing channel and with a left side panel and a right side panel each flanking and coupled to the curved electronic display panel, each with a sidewall defining a concave cavity, two opposing handle apertures, and two opposing bracket apertures;

a left U-shaped handle bracket disposed within the two opposing bracket apertures of the left side panel and coupled to a left handle member disposed within the concave cavity thereon for grasping by a user and disposed within the two opposing handle apertures of the left side panel and a right U-shaped handle bracket disposed within the two opposing bracket apertures of the right side panel and coupled to a right handle member disposed within the concave cavity thereon for grasping by the user and disposed within the two opposing handle apertures of the right side panel;

a printed circuit board disposed within the housing channel and electrically coupled to a power source, to at least one force sensor operably coupled to the left and right U-shaped handle brackets and operably configured to measure a tensile force applied to at least one of the left and right handle members, and to the curved electronic display panel; and a gyroscope electrically coupled to the printed circuit board and operably configured to align an image of the measured tensile force applied displayed on the curved electronic display panel with a handle plane defined by an orientation of the left and right handle members, the curved electronic display panel operably configured to display the image of the measured tensile force applied to the at least one of the left and right handle members around at least 180° of the curved electronic display panel.

* * * * *